US005372231A

United States Patent [19]

Völkening et al.

[11] Patent Number: 5,372,231

[45] Date of Patent: Dec. 13, 1994

[54] COMBPLATE FOR A PEOPLE MOVING DEVICE

[75] Inventors: Heinz Völkening, Hespe; Thomas Lis, Hanover; Peter von Riegen, Haste; Kay U. Wiechmann, Auetal, all of Germany

[73] Assignee: Otis Elevator Company, Farmington, Conn.

[21] Appl. No.: 173,745

[22] Filed: Dec. 23, 1993

[51] Int. Cl.[5] ..... B66B 29/06

[52] U.S. Cl. ..... 198/325

[58] Field of Search ..... 198/323–325

[56] References Cited

U.S. PATENT DOCUMENTS

| | | | |
|---|---|---|---|
| 2,953,232 | 9/1960 | Bankauf et al. | 198/325 |
| 3,137,382 | 6/1964 | Conover | 198/325 |
| 3,144,117 | 8/1964 | Fabula et al. | 198/325 |
| 3,458,025 | 7/1969 | Earle | 198/325 |
| 4,126,218 | 11/1978 | El Taher et al. | 198/325 |
| 4,800,998 | 1/1989 | Myrick | 198/325 X |
| 5,255,771 | 10/1993 | Nurnberg et al. | 198/323 |

FOREIGN PATENT DOCUMENTS

| | | | |
|---|---|---|---|
| 0077378 | 6/1977 | Japan | 198/324 |
| 1319778 | 6/1973 | United Kingdom | 198/325 |

*Primary Examiner*—D. Glenn Dayoan

[57] ABSTRACT

A one piece combplate for a people moving device is provided having a body, a rear support, and a comb attachment surface. The body, rear support, and comb attachment surface define a lengthwise cross-sectional profile which extends uniformly in a widthwise direction across the combplate.

4 Claims, 2 Drawing Sheets

COMBPLATE FOR A PEOPLE MOVING DEVICE

BACKGROUND OF THE INVENTION

1. Technical Field

This invention relates to people moving devices in general, and to combplates for people moving devices in particular.

2. Background Art

Escalators, moving walkways, and other people moving devices efficiently move a large volume of pedestrian traffic from one point to another. At each end of the device, landing areas provide access to moving steps (or belts, or pallets) traveling at a constant rate of speed. The landing areas typically include a floorplate and a combplate. The floorplate covers a structural frame which, in the landing, houses mechanical equipment for actuating the moving steps. The combplate is an intermediary surface between the stationary floorplate and the moving steps.

Historically, combplates and floorplates have included a steel body covered by a liner made of a wear and corrosion resistant material. The liner was typically attached to the floorplate or combplate by conventional fasteners such as rivets, which were often exposed. The liner was usually contoured to make the surface as slip resistant as possible.

A problem with the aforementioned floorplate and combplate arrangement is that the liners often vibrate loose or free from the underlying floorplate or combplate. Several disadvantages arise from loose or free liners. First, a liner vibrating against an underlying floorplate or combplate creates undesirable noise. A person of skill in the art will recognize that the "quietness" of a people moving device is perceived as an indicia of quality. Another disadvantage of a loose or free liner is that it presents a potential safety hazard for passengers entering and exiting the machine. Still another disadvantage of a loose or free liner is that the conventional fasteners may become free from the floorplate or combplate. Free fasteners may create undesirable noise within the device, as well as cause damage to the machinery inside of the landing of the device.

The weight of steel floorplates and combplates is another disadvantage of the prior art. Maneuvering heavy steel floorplates and combplates is almost always difficult and sometimes necessitates the use of a hoist.

DISCLOSURE OF THE INVENTION

It is, therefore, an object of the present invention to provide a combplate for a people moving device which minimizes noise.

It is a further object of the present invention to provide a combplate for a people moving device which minimizes maintenance.

It is a still further object of the present invention to provide a combplate for a people moving device which enhances the aesthetic appeal of the people moving device.

It is a still further object of the present invention to provide a lightweight, easily maneuvered combplate for a people moving device.

It is a still further object of the present invention to provide a combplate for a people moving device which may be used in a variety of applications.

According to the present invention, a one piece combplate for a people moving device is provided having a body, a rear support, and a comb attachment surface. The body, rear support, and comb attachment surface define a lengthwise cross-sectional profile which extends uniformly in a widthwise direction across the combplate.

According to one aspect of the present invention, the one piece combplate is formed by extrusion.

According to another aspect of the present invention, means for interlocking the combplate with the floorplate located adjacent the rear of the combplate is provided.

Several advantages spring from the present invention eliminating the need for a liner attached to the top surface of the combplate. One advantage is that a combplate according to the present invention is quieter over the life of the combplate. In the prior art, liners attached to the combplate by rivets or other conventional means typically vibrate loose or free. As a result, the combplate and the liner vibrate and create undesirable noise.

Another advantage of the present invention is that the present invention minimizes maintenance by eliminating the need to repair loose linings. Furthermore, the present invention eliminates the possibility that fasteners worked free from the combplate will damage other parts of the people moving device.

A still further advantage is that the present invention eliminates the need for unsightly conventional fasteners which attach the liner to the combplate. A person of skill in the art will recognize that aesthetics are considered quite important in the entry exit areas of the people moving device.

A still further advantage of the present invention is that the one piece cross-sectional profile of the combplate enables the combplate to be made from lightweight materials. As a result, the combplate is lightweight and easily maneuvered.

A still further advantage of the present invention is that the uniform cross-sectional profile allows the present invention to be used in a variety of different applications having different width combplates.

A still further advantage of the present invention is that the present invention eliminates the possibility that a liner will become loose or free and pose a potential safety hazard.

These and other objects, features and advantages of the present invention will become more apparent in light of the detailed description of the best mode embodiment, thereof, as illustrated in the accompanying drawings.

DETAILED DESCRIPTION OF THE DRAWINGS

BEST MODE FOR CARRYING OUT THE INVENTION

Figure 1:
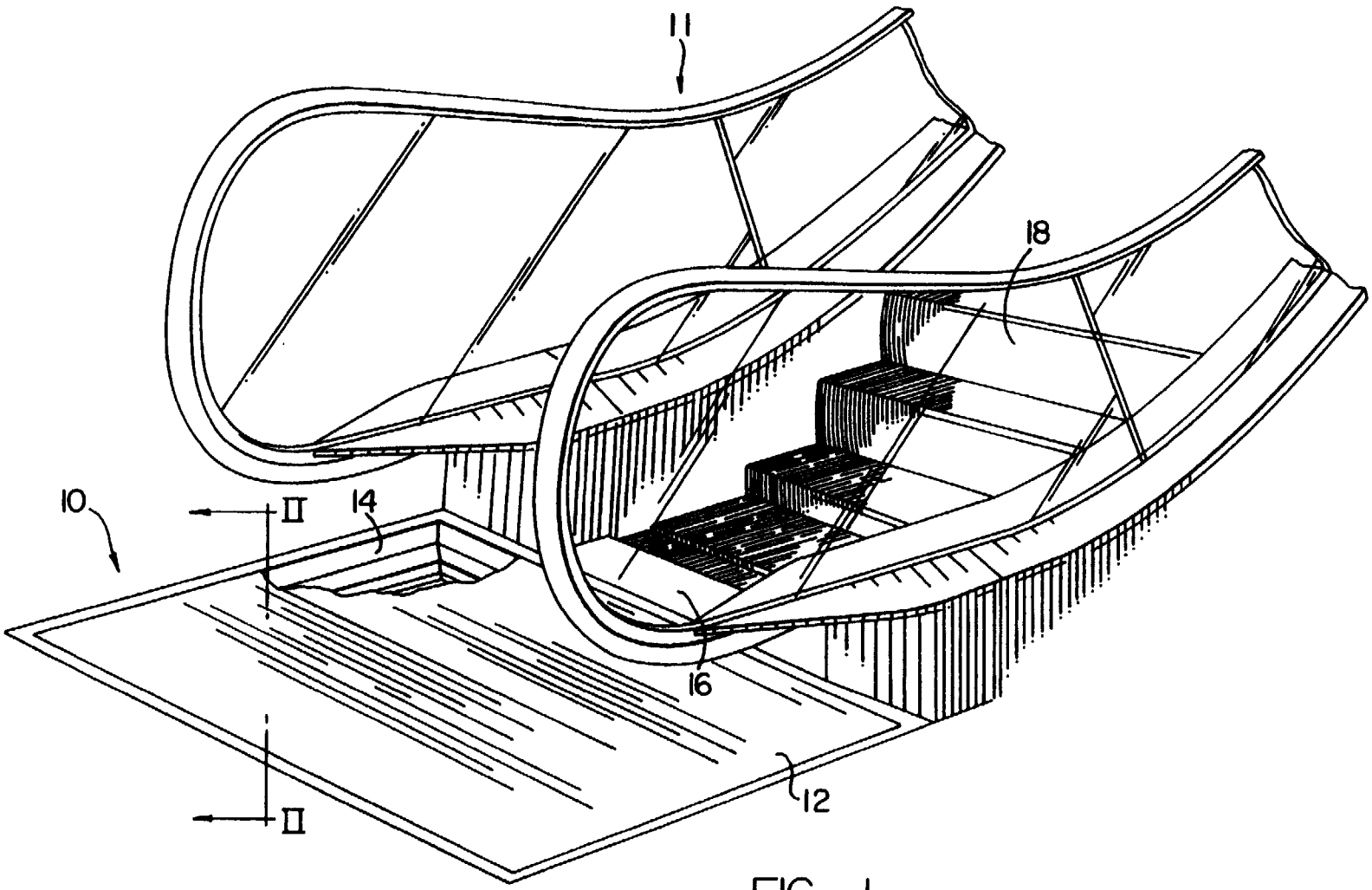
FIG. 1 is a diagrammatic view of the landing of a people moving device.

Now referring to FIG. 1, a landing 10 for an escalator 11 includes a floorplate 12, a floorplate frame 14, a combplate 16, and moving treadplates 18. The combplate 16 is an intermediary surface between the moving treadplates 18 and the stationary floorplate 12. The floorplate 12 covers the mechanical apparatus (not shown) in the landing 10. The floorplate frame 14 attaches to the structural frame 20 (see FIG. 2) of the escalator 11 and supports the floorplate 12 in the landing 10.

Figure 2:
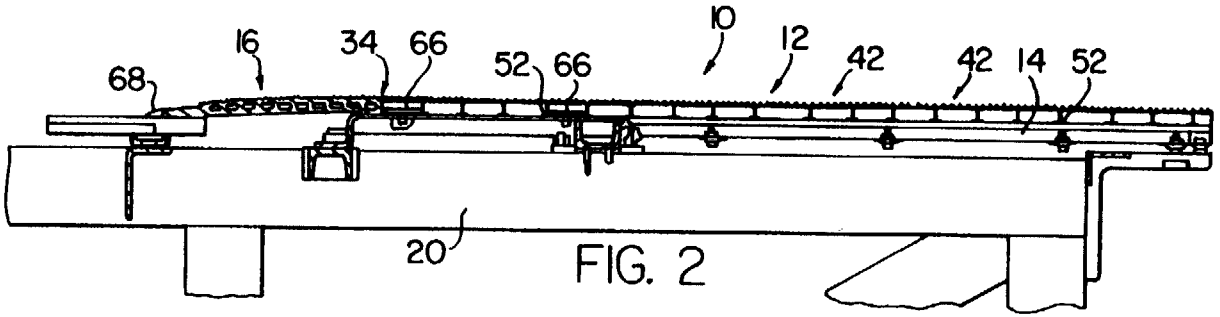
FIG. 2 is a diagrammatic side view of the combplate and floorplates mounted on the frame of the people moving device.
Figure 3:
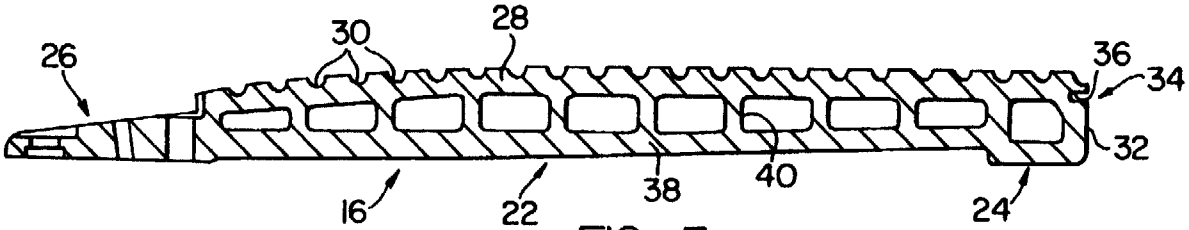
FIG. 3 is a cross-sectional view of the combplate.

Referring to FIG. 3, the combplate 16 is one piece structure which includes a body 22, a rear support 24, and a comb attachment surface 26. The body 22, defined by a length and a width (extending into the page), includes a top panel 28 which defines a top surface of the body 22, having a plurality of grooves 30 extending across the width of the body 22. The rear support 24 comprises a rectangular cross-section that extends downward from the body 22. The rear surface 32 of the rear support 24, i.e. the surface adjacent to the floorplate 12 after assembly (see also FIG. 2), includes means 34 for interlocking the combplate 16 with the adjacent floorplate 12. In the preferred embodiment, the interlocking means 34 comprises a mating male 35 (see FIG. 4) and female 36 pair. In FIG. 3, the female half 36 of the pair is shown extending into the rear support 24. A person of skill in the art will recognize that the male 35 and female 36 halves of the mating pair may be interchanged between the floorplate 12 (see FIG. 2) and the combplate 16.

In the preferred embodiment, the body 22 further comprises a bottom panel 38, which defines a bottom surface of the body 22, connected to the top panel 28 by ribs 40 extending therebetween. A person of skill in the art will recognize that the combplate 16 may comprise lengthwise cross-sectional profiles other than that shown in FIGS. 2 and 3.

The lengthwise cross-sectional profile of the combplate 16, defined by the body 22, rear support 24, and comb attachment surface 26, is formed by extruded aluminum. The extrusion gives the combplate 16 a widthwise extending uniform profile. A person of skill in the art will recognize that materials such as high density rigid plastics, and other extrudable materials may be used in place of aluminum. Alternatively, the one piece combplate 16 may be formed by a molding process.

Figure 4:
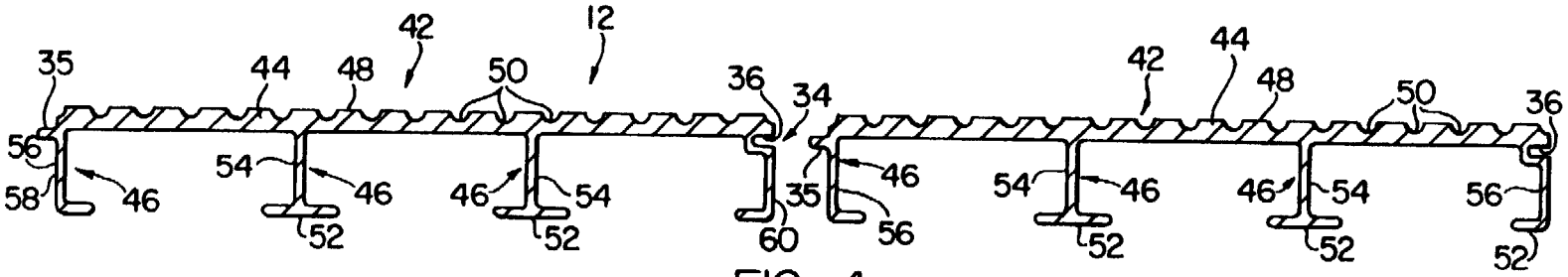
FIG. 4 is a cross-sectional view of the floorplate.

Referring to FIG. 4, the floorplate 12 is comprised of sections 42, each section 42 having a top panel 44 and supports 46. The exposed surface 48 of the top panel 44 includes a plurality of grooves 50 extending across the width of the floorplate section 42. The supports 46 extend outwardly from the top panel 44 and include bottom flanges 52 parallel to the top panel 44 for support. The supports in the middle of each floorplate section 42, or "middle supports" 54, have flanges 52 which extend out from both sides of the support. The supports at the ends of the floorplate section 42, or "end supports" 56, include flanges 52 which extend out in the direction of the middle supports 54 only.

The forward 58 and rear 60 edges of each floorplate section 42, also include means 34 for interlocking the floorplate section 42 with either the combplate 16, or the adjacent floorplate section 42. In the preferred embodiment, the interlocking means 34 comprises a mating male 35 and female 36 pair. In FIG. 4, the male half 35 of the pair is shown extending out of the forward edge 58 of the floorplate section 42 and the female half 36 extending into the rear edge 60 of the floorplate section 42. A person of skill in the art will recognize that the male 35 and female 36 halves of the mating pair could be interchanged between the forward 58 and rear 60 edges of each floorplate section 42.

The lengthwise cross-sectional profile of each floorplate section 42, defined by the top panel 44, supports 46, and bottom flanges 52, is formed by extruded aluminum. The extrusion gives the floorplate section 42 a uniform profile which extends in the widthwise direction. A person of skill in the art will recognize that materials such as high density rigid plastics, and other extrudable materials may be used in place of aluminum. Alternatively, each floorplate section 42 may be formed by a molding process.

Referring to FIG. 2, in the assembly of the escalator, the floorplate sections 42 are secured to the floorplate frame 14 by conventional fasteners 66. Specifically, the bottom flanges 52 are attached to the floorplate frame 14 by "T"-shaped head fasteners 66, or by conventional fasteners 66 used in conjunction with plates (not shown) extending between the supports 46. The number of floorplate sections 42 varies depending on the length of the landing 10. Different width landings 10 can be accommodated by altering the width of the floorplate sections 42.

Referring to FIG. 4, the floorplate sections 42 are joined to one another by the interlocking means 34. In the preferred embodiment, the end supports 56 of adjacent floorplate sections 42 are further joined together by the a "clinching" method (not shown). The clinching method uses a cylindrical stamp which makes a concentric depression in the two pieces to be joined. The deformed metal of one piece flares within the deformed metal of the other, thereby joining the two. The trademark "TOX", registered to Pressotechnik Gmbh, is used to describe this method.

Referring to FIG. 2, after the floorplate sections 42 are in place and secured, the combplate 16 is positioned and the interlocking means 34 of the combplate 16 and adjacent floorplate section 42 are coupled (see also FIGS. 3 and 4). Sections of comb 68 may be attached to the combplate 16 before or after the combplate 16 is attached to the landing 10. Different width landings 10 can be accommodated by altering the width of the combplate 16.

Although this invention has been shown and described with respect to the detailed embodiments thereof, it will be understood by those skilled in the art that various changes in form and detail thereof may be made without departing from the spirit and scope of the claimed invention.

We claim:

1. A one piece combplate for a people moving device, comprising:

a body, having
- a width,
- a length,
- a plurality of grooves extending widthwise across a top surface,
- a bottom surface, and
- a plurality of ribs, extending between said bottom and top surfaces;
- a rear support, extending out from said body on a surface opposite said grooved top surface; and a comb attachment surface;

wherein said body, said rear support, and said comb attachment surface define a lengthwise cross-sectional profile which extends uniformly in a widthwise direction.

2. A one piece combplate for a people moving device according to claim 1, further comprising:

means for interlocking said combplate with a floorplate located adjacent said rear support of said combplate.

3. A one piece combplate for a people moving device according to claim 2, wherein said means for interlocking comprises:

a mating male and female pair, one half of said pair attached to said rear support, and said other half of said pair attached to said floorplate;

wherein interlocking said combplate and said floorplate together minimizes relative movement between said combplate and floorplate.

4. A one piece combplate for a people moving device according to claim 3, wherein said mating male and female pair comprises:

a tongue groove; and a tongue.

* * * * *